US005590493A

United States Patent [19]

Wilson

[11] Patent Number: 5,590,493

[45] Date of Patent: Jan. 7, 1997

[54] WALL STRUCTURES FOR SWIMMING POOLS

[76] Inventor: Jean Wilson, 12 Cherry Lane, Kirkland, Quebec, H9H 4K2, Canada

[21] Appl. No.: 498,576

[22] Filed: Jul. 6, 1995

[51] Int. Cl.[6] ..... E04B 2/00

[52] U.S. Cl. ..... 52/108; 52/169.7; 52/245; 52/248; 52/630; 249/189; 249/18

[58] Field of Search ..... 52/108, 169.7, 52/309.4, 630, 71, 245, 248, 800.1, 631; 160/351, 230; 249/10, 18, 155, 159, 170, 171, 189, 209, 214, DIG. 3

[56] References Cited

U.S. PATENT DOCUMENTS

| | | | |
|---|---|---|---|
| 2,197,318 | 4/1940 | Rumble | 52/108 X |
| 2,829,081 | 4/1958 | Sweem | 160/230 X |
| 3,974,605 | 8/1976 | Beatty et al. | 52/169.7 X |
| 4,464,802 | 8/1984 | Glonek et al. | 52/169.7 X |
| 4,566,141 | 1/1986 | Mahoney | 52/169.7 X |
| 4,671,028 | 6/1987 | Figone | 52/631 X |
| 4,679,763 | 7/1987 | Brotherton | 249/189 |
| 4,915,345 | 4/1990 | Lehmann | 249/18 |
| 5,137,251 | 8/1992 | Jennings | 249/189 |

*Primary Examiner*—Robert Canfield
*Attorney, Agent, or Firm*—Eric Fincham

[57] ABSTRACT

There is provided a panel structure for the side walls of an inground pool, the panel having vertical lines of weakening formed therein permitting it to assume various arcuate configurations, both concave and convex. This arrangement permits a single panel to be used for both straight and curved wall sections.

11 Claims, 9 Drawing Sheets

WALL STRUCTURES FOR SWIMMING POOLS

BACKGROUND OF THE INVENTION

The present invention relates to a panel structure and more particularly, relates to a panel structure suitable for use in an inground swimming pool wall arrangement.

Inground swimming pools can be formed to have a variety of different structures. These structures range from a full concrete pool wherein the concrete is poured or sprayed (gunite) to other more recent types of structures wherein the base of the pool is formed of concrete and is then covered with a liner which covers the base and a wall structure. The use of prefabricated walls has started to become more popular since this can both be a more economical arrangement while also allowing for flexibility in the pool structure.

The construction of an inground concrete pool requires the use of skilled labour during construction of the same. Accordingly, there have been various proposals for the use of wall panels which will both save money and allow the use of less skilled labour. However, the use of these wall panels provides limited flexibility insofar as the design of the pool is concerned. In other words, usually only a limited number of panels of a standard size and/or curvature, are provided. Frequently one is limited to corners of a certain radius and arcuate sections cannot be readily built. While it would be possible to have panels of all different configurations, the economic reality of mold costs and stocking of such panels precludes their use.

SUMMARY OF THE INVENTION

It is an object of the present invention to provide a panel suitable for a side wall of an inground swimming pool structure, and which panels can be formed to assume different curvatures.

It is a further object of the present invention to provide an inground swimming pool arrangement wherein a single side wall panel can be used.

It is a further object of the present invention to provide a swimming pool panel which is economical and may be used in a variety of different applications.

According to one aspect of the present invention, there is provided a panel which is suitable for forming the side wall of an inground pool, the panel having a front face, a rear face, a top peripheral edge, a bottom peripheral edge and side peripheral edges. The front face is the one which faces inwardly to the pool and as such, has a substantially continuous surface. The rear face has a plurality of reinforcing flanges extending outwardly therefrom while there are also provided a plurality of lines of weakening comprising areas of diminished panel thickness which extend substantially vertically between the upper peripheral edge and the bottom peripheral edge to thereby permit flexing of the panel.

The panel may be formed of several different materials although a structural foam material is widely used for the these types of structures. In particular, a polypropylene structural form is suitable although any material having the required strength and rigidity and which can be adapted for the purposes of the present invention could be used.

The lines of weakening, which extend in a vertical direction, permit the flexing of the panel into different configurations. One means of providing the lines of weakening is to have a reduced panel thickness at the areas of the lines of weakening to permit the flexing thereof. Typically, when using a material such as a polypropylene structural foam, one could utilize a wall panel having a thickness of between ⅛" and ½" and preferably between ¼" and ⅜" while in the areas of reduced thickness, the panel would have a thickness of between 0.020 and 0.200 and preferably between 0.050 and 0.100.

The number of lines of weakening can vary and it is well within the skill of those knowledgeable in the art to calculate a desirable number given the end purpose. For most purposes, the spacing between the lines of weakening may be between ½" and 8" and preferably between 2" and 6".

On the rear face of the panel, there can be provided a plurality of reinforcing means which usually comprise ribs or flanges. With the vertical lines of weakening, it has been found that having one reinforcing flange or rib extending vertically between each line of weakening is sufficient for most purposes.

It is also desirable to have upper and lower flange elements; the upper flange elements for receiving and supporting the pool coping while the lower flange elements can be used to attach the panel member to a substrate which may be the bottom of the pool. Naturally, the upper and lower flanges must have means to permit flexing or bending of the wall panel in both the concave and convex configurations and to this end, the upper and lower flanges are preferably divided into a plurality of flange elements as will be shown in greater detail in the preferred embodiment described hereinbelow.

In the preferred embodiment, there are provided means for securing the panel in its desired configuration. To this end, there may be provided a securing member or strap which will extend transversely along the rear face of the panel and which has means for being secured thereto.

In one particularly preferred embodiment, the vertically extending reinforcing flanges have apertures formed therein adapted to receive a mechanical fastener such as a screw or the like. The reinforcing member or strap would likewise have a plurality of apertures formed therein, the apertures being spaced apart a distance according to the desired curvature of the panel. In other words, as the panels are flexed into a desired configuration, the distance between the vertical reinforcing flanges or ribs will vary. By correctly calculating these distances, the reinforcing strap could have apertures spaced apart by a distance which would correspond to the desired curvature or lack thereof. As will be appreciated, one could readily envisage an arrangement wherein a pool designer could design a free form pool and at the same time, generate the spacing between the apertures. By so doing, installation using the panels of the present invention would be simplified.

Having thus generally described the invention, reference will be made to the accompanying drawings illustrating an embodiment thereof, in which:

DESCRIPTION OF THE PREFERRED EMBODIMENTS

Figure 1:
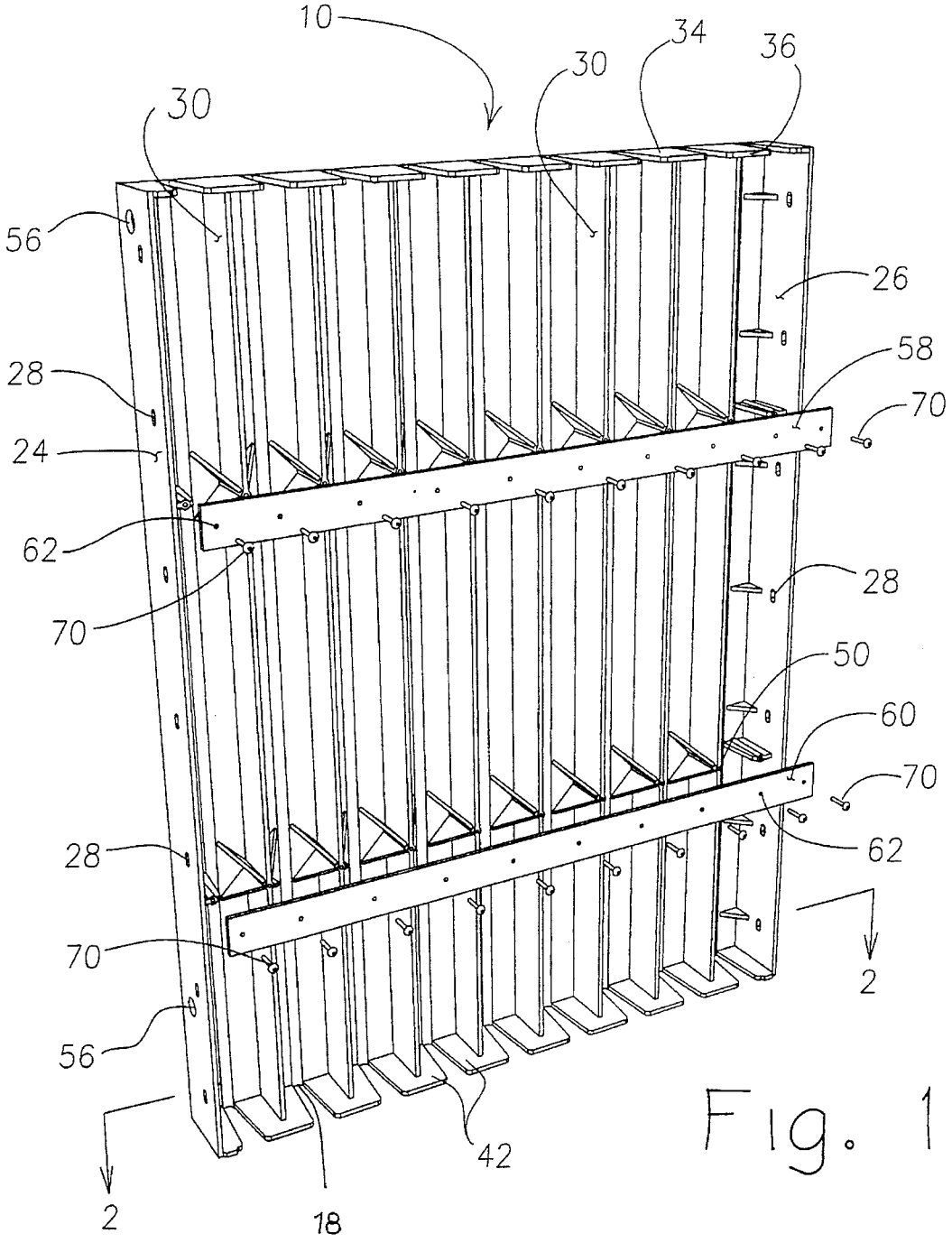
FIG. 1 is an exploded view illustrating the rear of a wall panel according to the present invention in a straight position.
Figure 2:
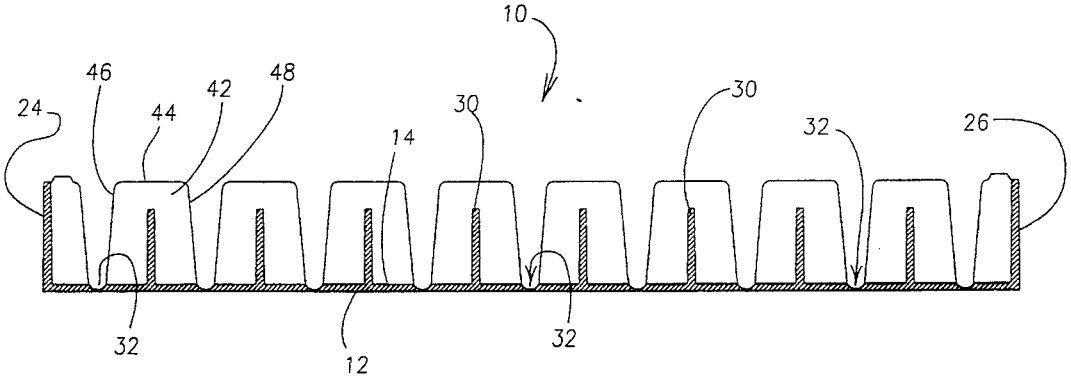
FIG. 2 is a sectional view taken along lines 2—2 of FIG. 1.

Referring to the drawings in greater detail and by reference characters thereto, there is provided a wall panel suitable for an inground pool construction and which panel is generally designated by reference numeral 10.

Panel 10 has a front face 12 and a rear face 14. The panel is bounded by an upper edge 16, a lower edge 18 and side edges 20 and 22 extending between upper edge 16 and lower edge 18. Located at side edge 20 is a rearwardly extending side wall 24 and similarly, adjacent side edge 22 is a rearwardly extending side wall 26. Both side walls 24 and 26 have a plurality of apertures 28 formed therein.

Extending outwardly from rear face 14 and being arranged in a generally vertical parallel configuration are a plurality of vertical flanges 30.

Figure 3:
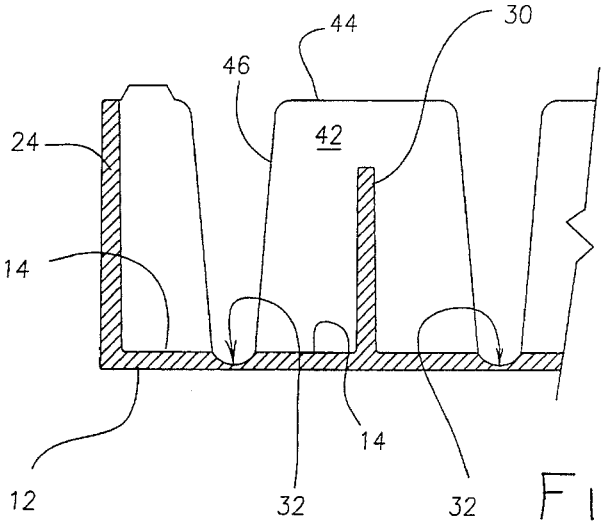
FIG. 3 is an enlarged detailed view of a portion of FIG. 2.

As may be best seen in FIG. 3, intermediate vertical flanges 30 are a plurality of vertically extending grooves 32 which form lines of weakening. Thus, as may be seen, panel 10 has a thickness which is less at grooves 32 than the standard wall thickness.

Extending rearwardly from upper edge 16 are a plurality of upper flange elements generally designated by reference numeral 34. Upper flange elements 34 have a distal end 36 with side edges 38 and 40. As may be seen, upper flange elements 34 have a generally trapezoidal configuration with sides 38 and 40 tapering inwardly towards each other as they extend to distal end 36.

The panel also includes lower flange elements 42 which, like upper flange elements 34, have a generally trapezoidal configuration with sides 46 and 48 tapering inwardly to distal end 44.

Figure 4:
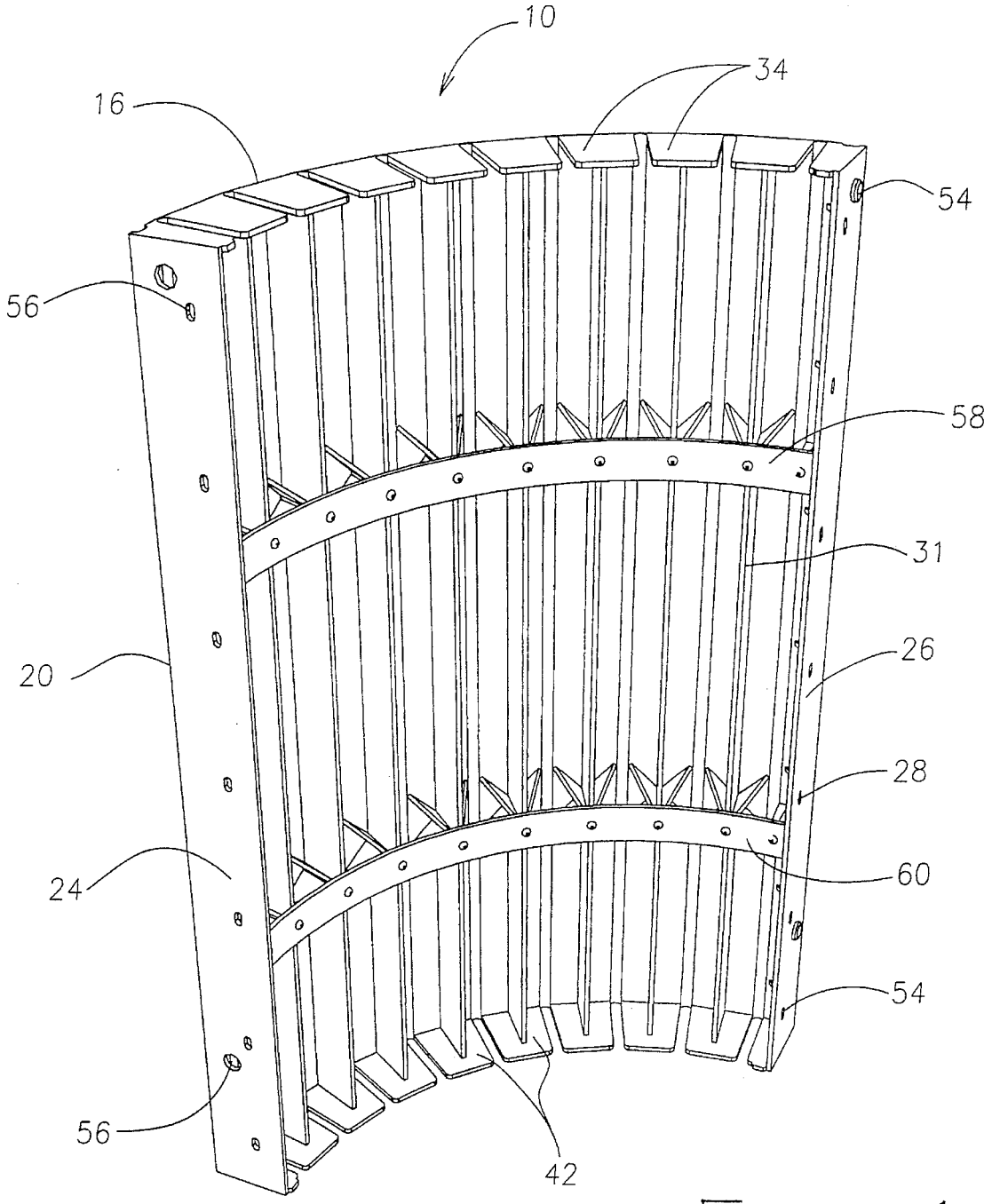
FIG. 4 is a perspective view similar to FIG. 1 showing an assembled panel bent in a reverse radius configuration.
Figure 5:
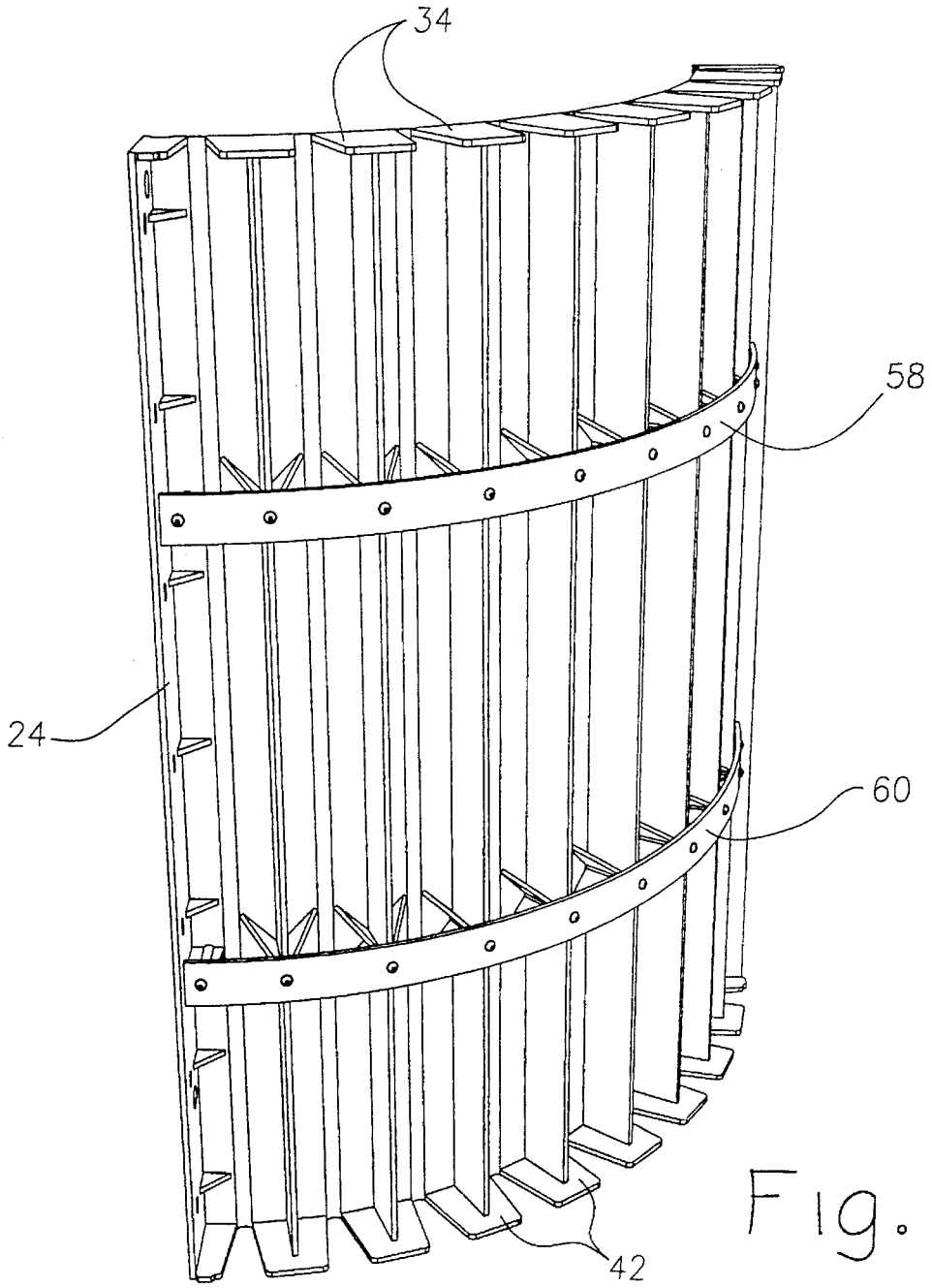
FIG. 5 is a perspective view similar to FIG. 1 showing an assembled panel bent in a standard radius form.
Figure 6:
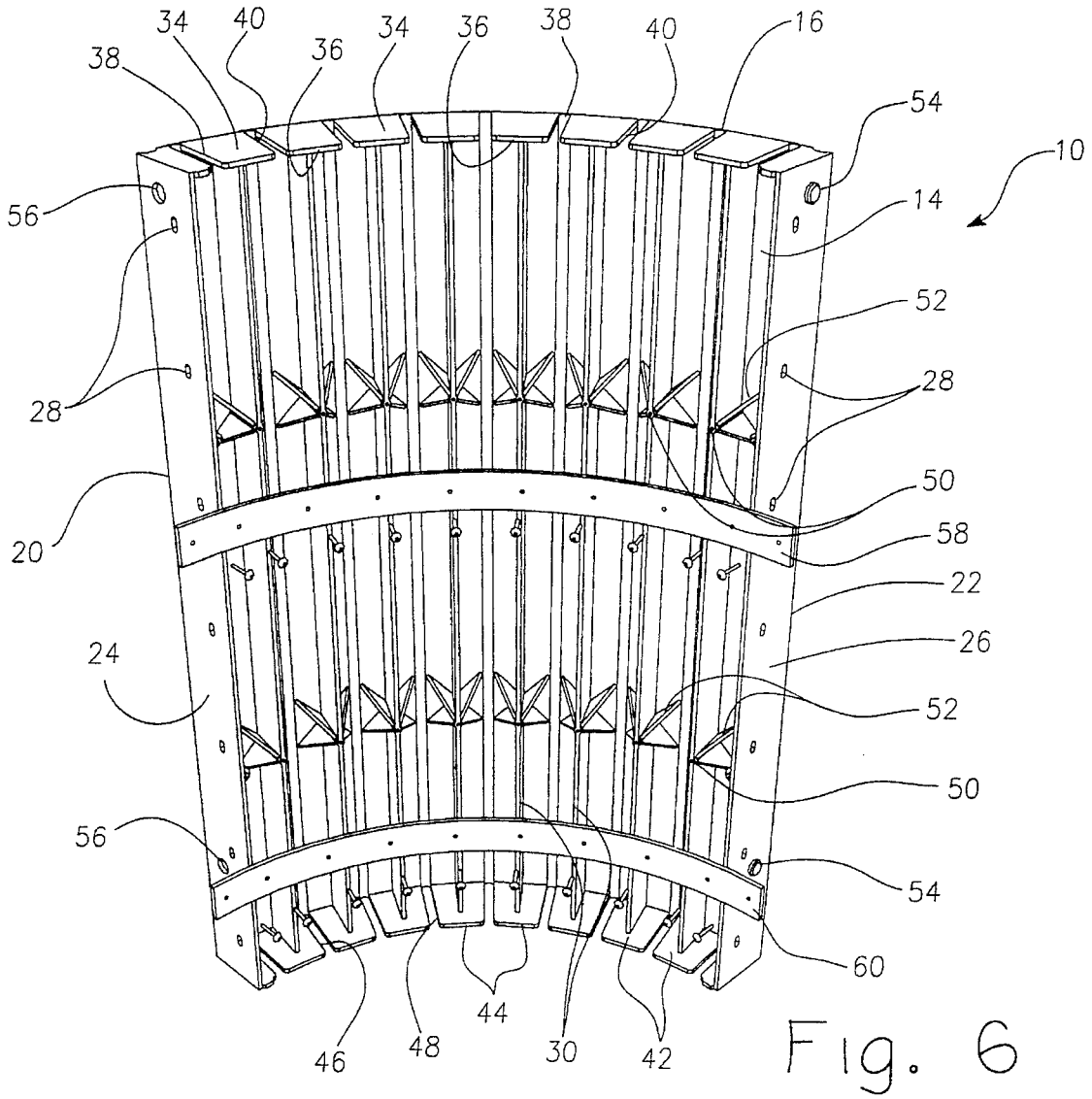
FIG. 6 is an exploded view of the panel of FIG. 4.
Figure 7:
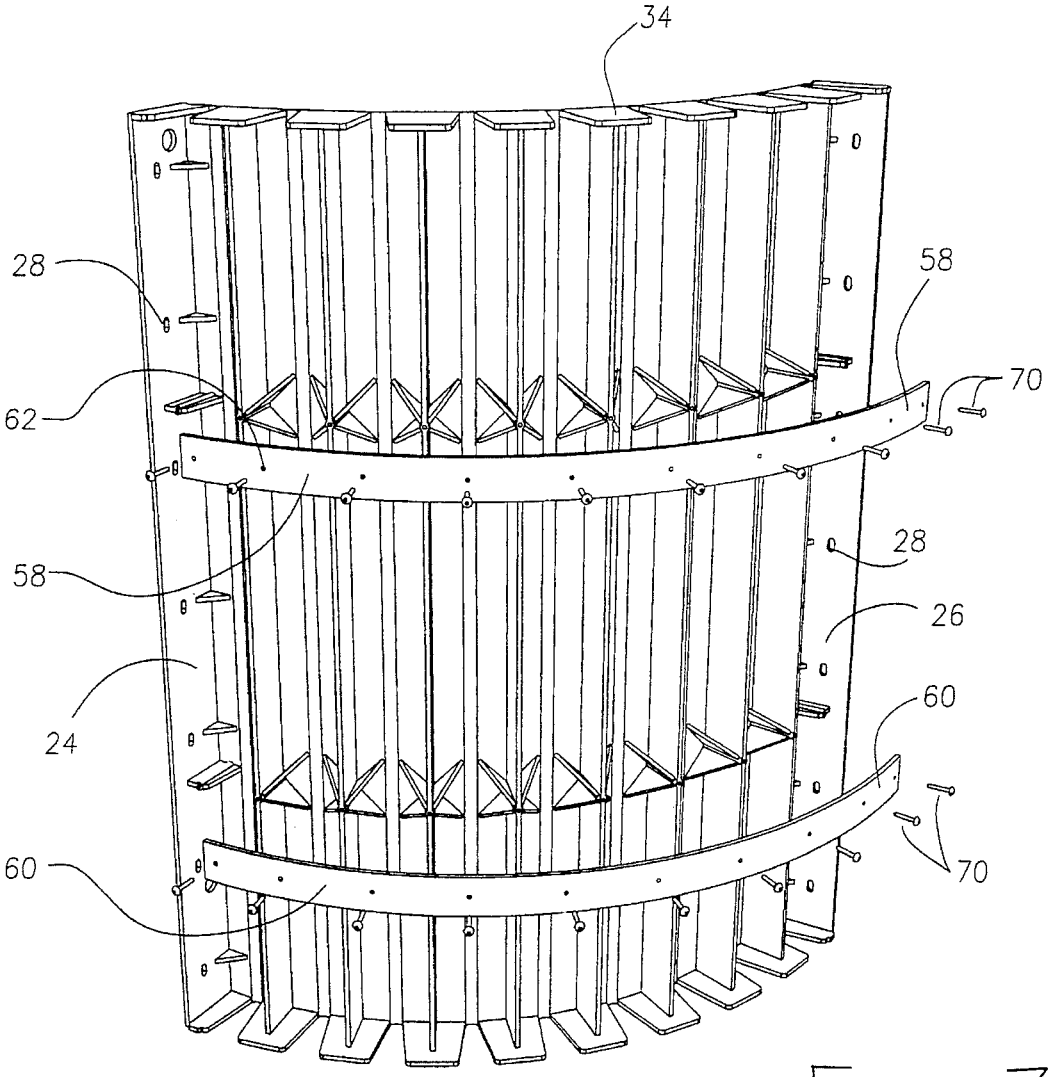
FIG. 7 is an exploded view of the panel of FIG. 5.

The above arrangement is such that the panel may be bent in the standard radius configuration as shown in FIGS. 5 and 7 to provide an arcuate concave configuration for front face 12. Similarly, the grooves 32 or lines of weakening also will permit bending of the panel in a reverse radius configuration as shown in FIGS. 4 and 6 to have a convex configuration. In this respect, it will be noted that the tapered edges of the upper flange elements 34 and lower flange elements 42 allow panel 10 to assume the reverse radius configuration.

In the illustrated embodiment, vertical flanges 30 have vertical flange apertures 50 formed therein. To reinforce the area about the apertures 50, a plurality of reinforcing elements 52 are formed and which elements extend between vertical flanges 30 and rear face 14. It will also be noted that side wall 24 includes upper and lower locating lugs 54. Locating lugs 54 are adapted to mate with locating apertures 56 in an adjacent side wall such as is shown in side wall 24.

As shown in the Figures, there may be provided an upper strap member 58 and a lower strap member 60 each of which has apertures 62 formed therein. The arrangement is such that a fastening device is adapted to fit through an aperture 62 in upper strap 58 and through vertical flange apertures 50. Suitable mechanical fastening means such as screws 70 may be utilized. To connect the side walls 24 and 26, a fastening element 64 also having an aperture 66 therein may be utilized.

Figure 8:
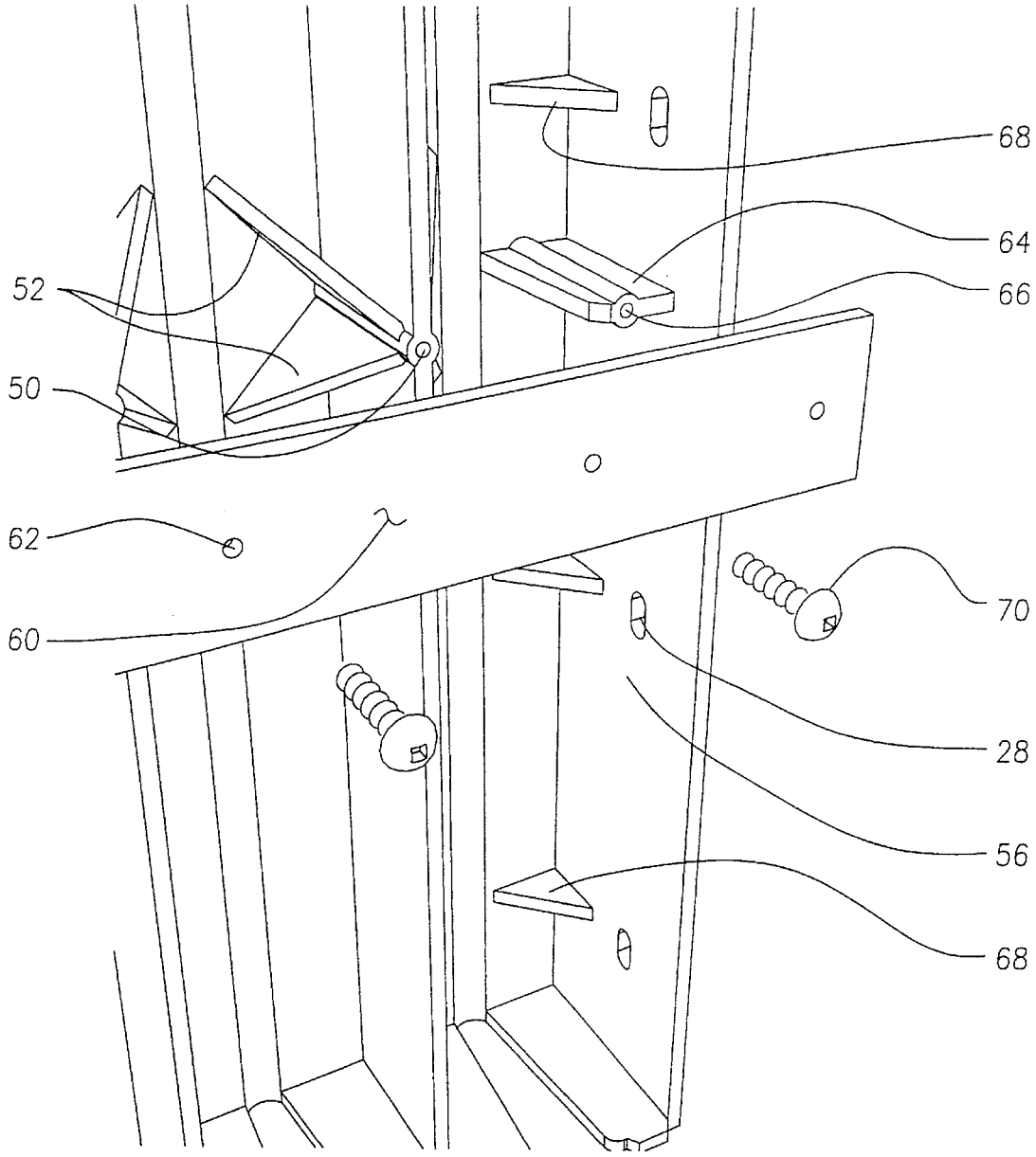
FIG. 8 is a detailed view showing connecting of the strap at the rear of the panel.

For structural purposes, a plurality of reinforcing elements 68 are provided adjacent the side walls and rear face such as shown in FIG. 8.

Figure 9:
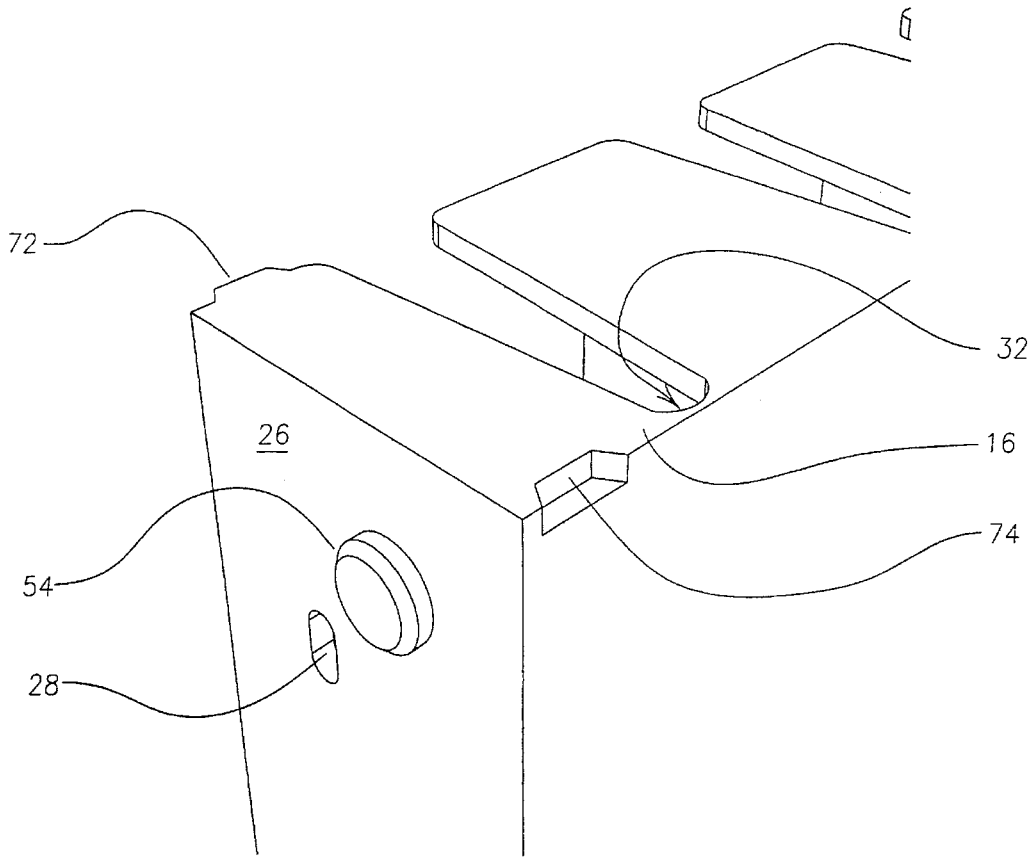
FIG. 9 is a detailed view of an upper corner of a panel.
Figure 10:
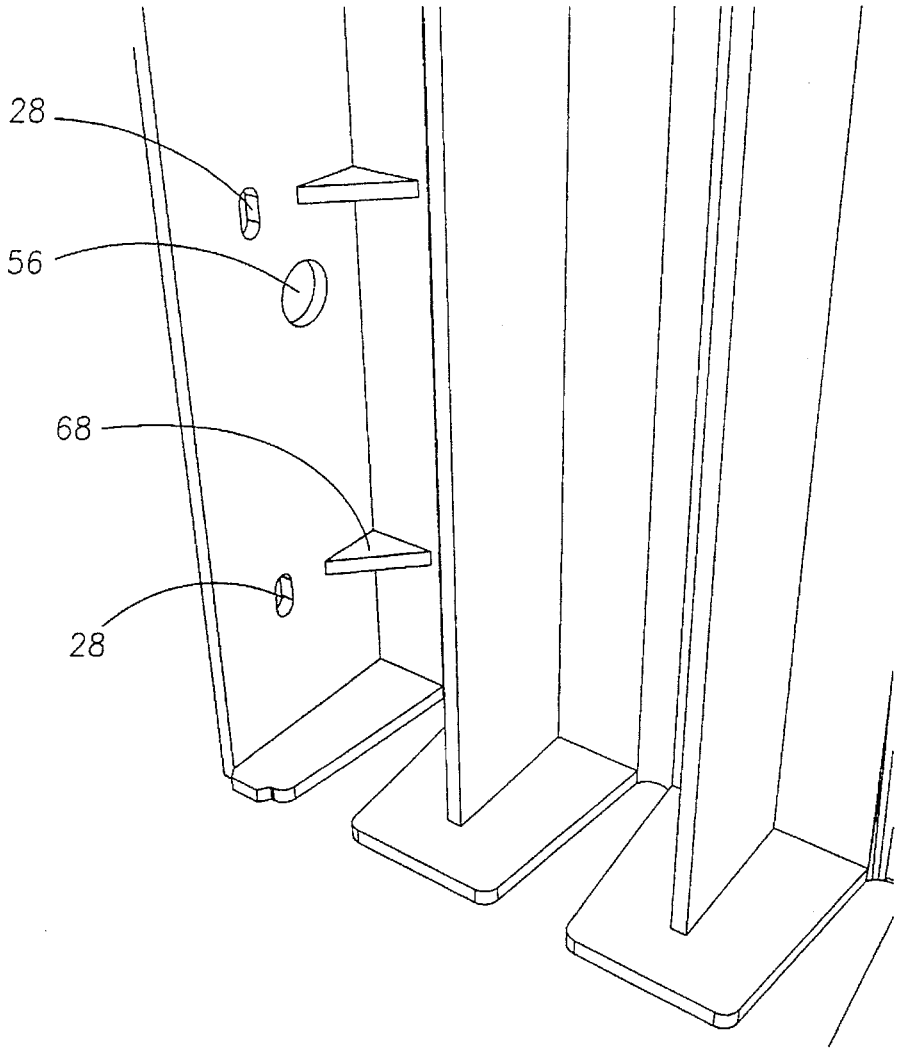
FIG. 10 is a detailed view of a lower corner of the panel.

For purposes of transport wherein a plurality of panels are stacked, and as may be seen in FIG. 9, a tab 72 may be formed on the distal end of the flange adjacent wall 26 with a corresponding recess 74 formed at upper edge 16. Tab 72 is adapted to mate with recess 74 on an adjacent panel when the panels are in a stacked arrangement.

In operation, once the desired radius of a pool section is known, one can then calculate the required distance between apertures 62 in straps 58 and 60. After the apertures are formed the installer merely needs to connect straps 58 and 60 in the required manner and the panel will automatically assume the desired curvature. This curvature can range from a straight line through both concave and convex configurations. Thus, it is possible to stock only standard panels while the straps having apertures at the desired location can then be manufactured.

It will be understood that the above described embodiment is for purposes of illustration only and that changes and modifications may be made thereto without departing from the spirit and scope of the invention.

I claim:

1. A panel suitable for forming a side wall of an inground pool, the panel having a front face, a rear face, an upper peripheral edge, a bottom peripheral edge, and side peripheral edges, said front face having a substantially continuous surface, a plurality of reinforcing flanges extending outwardly from said rear face, and a plurality of lines of weakening extending substantially vertically between said upper peripheral edge and said bottom peripheral edge to thereby permit flexing of said panel, said lines of weakening comprising areas of diminished panel thickness.

2. The panel of claim 1 wherein said lines of weakening are substantially parallel.

3. The panel of claim 2 wherein said lines of weakening are spaced apart a distance of between 2 and 6 inches.

4. The panel of claim 2 wherein said reinforcing flanges are evenly spaced between said lines of weakening.

5. The panel of claim 2 further including a plurality of upper flange elements extending from said upper peripheral edge and a plurality of bottom flange elements extending outwardly from said bottom peripheral edge.

6. The panel of claim 5 wherein said upper flange elements and said lower flange elements each have a general trapezoidal configuration with said elements extending from between said lines of weakening rearwardly and having inwardly tapering walls to a distal end thereof.

7. The panel of claim 2 further including means for securing said panel in an arcuate position.

8. The panel of claim 7 wherein said means comprises a transversely extending member adapted to be secured to said vertical flanges.

9. The panel of claim 8 wherein said vertical flanges have apertures formed therein, said securing means comprising spaced apart apertures in said transversely extending member and mechanical fastening means.

10. The panel of claim 1 wherein said panel is formed of structural foam material.

11. The panel of claim 10 wherein said structural foam is a polypropylene foam.

* * * * *